US008510867B2

(12) United States Patent
Errigo

(10) Patent No.: US 8,510,867 B2
(45) Date of Patent: Aug. 20, 2013

(54) APPARATUS AND METHOD FOR MATCHING SOCKS

(76) Inventor: Danielle C. Errigo, Roy, UT (US)

( * ) Notice: Subject to any disclaimer, the term of this patent is extended or adjusted under 35 U.S.C. 154(b) by 345 days.

(21) Appl. No.: 12/609,991

(22) Filed: Oct. 30, 2009

(65) Prior Publication Data

US 2010/0047747 A1 Feb. 25, 2010

Related U.S. Application Data

(63) Continuation-in-part of application No. 11/760,590, filed on Jun. 8, 2007, now abandoned.

(51) Int. Cl.
*A43B 17/00* (2006.01)

(52) U.S. Cl.
USPC ..... 2/239

(58) Field of Classification Search
USPC ..... 2/239, 409, 244, 245, 246; 434/191, 434/171, 129, 395, 397, 398
See application file for complete search history.

(56) References Cited

U.S. PATENT DOCUMENTS

| | | | | |
|---|---|---|---|---|
| 163,912 | A | 6/1875 | Birmeli | |
| D19,161 | S | 6/1889 | Howe | |
| 777,268 | A | 12/1904 | Thompson | |
| 902,573 | A | 11/1908 | Fleck | |
| 1,396,379 | A | 11/1921 | Moore | |
| 1,538,529 | A * | 5/1925 | Troidl | 434/167 |
| 1,558,229 | A * | 10/1925 | Bowman | 273/296 |
| 1,666,996 | A * | 4/1928 | Hazen | 273/299 |
| 1,745,946 | A | 2/1930 | Murray | |
| D147,176 | S | 7/1947 | Guttman | |
| 2,621,501 | A | 12/1952 | Jenkins | |
| 2,796,680 | A | 6/1957 | Wittcoff | |
| 2,814,807 | A | 12/1957 | Dollar | |
| 3,135,442 | A | 6/1964 | Carter | |
| 3,258,858 | A | 7/1966 | Cariffe, Jr. | |
| 3,302,310 | A * | 2/1967 | Leven | 434/171 |
| 3,570,158 | A | 3/1971 | Hackett | |
| 3,775,775 | A | 12/1973 | Mazzenga | |
| 3,906,642 | A | 9/1975 | Cohen | |
| 4,005,494 | A | 2/1977 | Burn | |
| 4,050,698 | A | 9/1977 | Brown | |

(Continued)

FOREIGN PATENT DOCUMENTS

| | | | |
|---|---|---|---|
| GB | 2167592 | A | 5/1986 |
| JP | 62057901 | A | 3/1987 |
| JP | 2002020903 | | 1/2002 |

OTHER PUBLICATIONS http://sport.lohnko-ing.si/lecoqsportif/tenis.html; Lohnko Sport—Story Socks; as of Apr. 4, 2008.

(Continued)

*Primary Examiner* — Alissa L Hoey
(74) *Attorney, Agent, or Firm* — Kunzler Law Group, PC

(57) ABSTRACT

An apparatus for educating children includes a first symbol for application to a first article of clothing and a second symbol for application to a second article of clothing. The first article of clothing is worn by a user at a same time as the second article of clothing and the first article of clothing and the second article of clothing are both part of a clothing set. The second symbol is non-identical to the first symbol and the first symbol corresponds to and matches the second symbol based on a relationship of an educational topic.

7 Claims, 5 Drawing Sheets

(56) References Cited

U.S. PATENT DOCUMENTS

| | | | | | |
|---|---|---|---|---|---|
| 4,089,722 | A | * | 5/1978 | Holoubek | 156/235 |
| 4,445,233 | A | | 5/1984 | Rubin | |
| 4,514,178 | A | | 4/1985 | Noto et al. | |
| 4,519,781 | A | | 5/1985 | Boyd | |
| 4,627,110 | A | | 12/1986 | Tengs | |
| 4,712,319 | A | | 12/1987 | Goria | |
| 4,734,938 | A | | 4/1988 | Anderson | |
| 4,832,606 | A | | 5/1989 | Clark et al. | |
| 4,958,388 | A | | 9/1990 | Madden | |
| 4,991,233 | A | | 2/1991 | Hall | |
| 4,999,848 | A | | 3/1991 | Oney | |
| 5,027,440 | A | | 7/1991 | Morris et al. | |
| 5,038,413 | A | | 8/1991 | Ursino | |
| 5,141,235 | A | * | 8/1992 | Hernandez | 273/308 |
| 5,205,563 | A | * | 4/1993 | Dearing | 273/296 |
| 5,240,418 | A | | 8/1993 | Silverman et al. | |
| 5,244,233 | A | | 9/1993 | McCraney | |
| 5,275,818 | A | | 1/1994 | Kind | |
| 5,282,749 | A | | 2/1994 | Ketch | |
| 5,290,043 | A | | 3/1994 | Vidinic | |
| 5,367,809 | A | | 11/1994 | Ross | |
| 5,507,495 | A | * | 4/1996 | Kiss | 273/243 |
| 5,523,145 | A | * | 6/1996 | Buras, Jr. | 428/32.6 |
| 5,554,032 | A | | 9/1996 | Troudet | |
| 5,579,541 | A | | 12/1996 | Christy et al. | |
| 5,586,341 | A | | 12/1996 | Hill | |
| 5,586,888 | A | | 12/1996 | Webb | |
| 5,699,557 | A | | 12/1997 | Johnson | |
| 5,708,984 | A | | 1/1998 | Shofner | |
| 5,725,725 | A | | 3/1998 | Salvetti | |
| 5,745,918 | A | | 5/1998 | Shukla et al. | |
| D395,921 | S | | 7/1998 | Funk et al. | |
| 5,803,742 | A | * | 9/1998 | Buti | 434/157 |
| 5,840,153 | A | * | 11/1998 | Sieber | 156/542 |
| D410,149 | S | | 5/1999 | Sweeney | |
| 5,983,402 | A | | 11/1999 | Fincher | |
| 6,062,864 | A | * | 5/2000 | Rood | 434/191 |
| 6,079,710 | A | * | 6/2000 | Brown | 273/269 |
| 6,082,146 | A | | 7/2000 | Dahlgren | |
| 6,099,318 | A | * | 8/2000 | McLeod et al. | 434/129 |
| 6,106,022 | A | * | 8/2000 | Badash et al. | 283/81 |
| 6,109,924 | A | | 8/2000 | Sanford et al. | |
| 6,142,785 | A | | 11/2000 | Williams | |
| 6,155,836 | A | | 12/2000 | Hancock | |
| 6,209,141 | B1 | | 4/2001 | Adeli | |
| 6,216,279 | B1 | | 4/2001 | Ellingson | |
| 6,279,169 | B1 | | 8/2001 | Reichle | |
| 6,318,283 | B1 | | 11/2001 | Coulthard, Jr. | |
| 6,405,381 | B1 | | 6/2002 | Bowman | |
| 6,447,300 | B1 | | 9/2002 | Greenberg | |
| 6,584,618 | B1 | | 7/2003 | Mirharooni | |
| D477,904 | S | | 8/2003 | Oliver | |
| 6,746,249 | B1 | | 6/2004 | Claunch | |
| 6,782,554 | B1 | | 8/2004 | Froehlich | |
| 7,029,281 | B1 | * | 4/2006 | Rathyen | 434/129 |
| 7,077,654 | B2 | | 7/2006 | Burtness | |
| 7,296,999 | B2 | | 11/2007 | Webber | |
| 2002/0020082 | A1 | | 2/2002 | James | |
| 2004/0216219 | A1 | | 11/2004 | Brevoort | |
| 2005/0022288 | A1 | | 2/2005 | Habert | |
| 2005/0102734 | A1 | | 5/2005 | Daniel et al. | |
| 2007/0220652 | A1 | | 9/2007 | Kuharcik et al. | |

OTHER PUBLICATIONS http://web.archive.org/web/200600621160488/http://sport.lohnko-ing.si/lecoqsportif/tenis.html; Lohnko Sport—Story Socks; as of Jun. 21, 2008.

http://web.archive.org/web20060328024856/www.littlemissmatched.com/store/product_index?Args=; MissMatched Socks; as of Mar. 28, 2006.

http://theswca.com/index.php?action=disp_item&item_id=387; Star Wars Archive Database.

file://C:\DOCUME~1\Temp\Y542QOOG.htm; Star Wars Archive Database.

http://www.mojolondon.co.uk/children/baby/clothing/blue_snap_t-shirt_set_0-6.htm; as of Dec. 22, 2006.

http://web.archive.org/web/20060328024856/www.littlemissmatched.com/store/Marvelous3P_M0033?Arg=&size=; MissMarchedSocks—Marvelous 33,34,35; as of Mar. 28, 2006.

http://abcnews.go.com/Business/wireStory?id=3182986; "Le Coq Sportif to Open U.S. Subsidiary"; p. 1, paragraph 5.

* cited by examiner

APPARATUS AND METHOD FOR MATCHING SOCKS

CROSS-REFERENCES TO RELATED APPLICATIONS

This is a continuation-in-part application of and claims priority to U.S. patent application Ser. No. 11/760,590 entitled "Sock Matching Apparatus and Method" and filed on 8 Jun. 2007 for Danielle C. Errigo, which is incorporated herein by reference.

BACKGROUND OF THE INVENTION

1. Field of the Invention

This invention relates to educational games and activities, and more particularly to educational sock matching apparatuses and methods.

2. Description of the Related Art

The work of doing laundry is a never ending task that can take a large amount of time and may be quite tedious. The task of matching sets of clothing, and in particular pairs of socks, illustrates one task of laundry that is time consuming and can sometimes be boring. Various methods have been proposed for assisting in the pairing of matching socks, including marking an identical sign on each sock (e.g., "Tommy's black socks") for matching purposes. Other methods include putting a set of identical decals on the socks or simply matching them the old-fashioned way, by size, shape, texture, pattern, and color. Other prior art apparatuses include marking the socks with their particular color (marking a blue sock with the word "blue," for example) for teaching color to children or to assist people who are color-blind.

What prior art apparatuses and methods have failed to recognize is that the problem of matching socks brings with it a teaching opportunity, regarding both how to match socks as well as teach and reinforce other types of knowledge, including telling time, languages, geography, reading, mathematics, and just about any other field of knowledge.

SUMMARY OF THE INVENTION

From the foregoing discussion, it should be apparent that a need exists for a matching apparatus and method that overcome the problems of the prior art. The present invention has been developed in response to the present state of the art, and in particular, in response to the problems and needs in the art that have not yet been fully solved by currently available matching apparatuses and methods. Accordingly, the present invention has been developed to provide a matching apparatus and method that can provide a game that will make matching socks enjoyable and educational to children.

In one aspect of the invention, an apparatus for educating children includes a first symbol for application to a first article of clothing and a second symbol for application to a second article of clothing. The first article of clothing is worn by a user at a same time as the second article of clothing and the first article of clothing and the second article of clothing are both part of a clothing set. The second symbol is non-identical to the first symbol. In one embodiment, the first symbol corresponds to and matches the second symbol based on a relationship of an educational topic. In certain embodiments, the first symbol in the symbol pair and the second symbol of the symbol pair each consist of a printed image, wherein the second symbol is not a printed image that is a reverse image of the printed image in the first symbol. In a further embodiment, the first symbol in the symbol set does not include an image in addition to the printed image that is included on the first symbol as an identical match to a corresponding identical additional image on the second symbol of the symbol set and in addition to the printed image on the second symbol. In another embodiment, wherein the first article of clothing comprises a stocking and the second article of clothing comprises a stocking and the clothing set comprises a pair of the stockings.

In a further embodiment, the apparatus includes two or more first and second symbols. Each first symbol and each second symbol makes up a set. Furthermore, the two or more first and second symbols are each applied to corresponding first and second articles of clothing and the symbols and articles of clothing make up a matching game. The game involves selecting a first article of clothing with a first symbol and selecting a second article of clothing with a matching second symbol. In one embodiment, the two or more first and second symbols include a set of iron-on transfers. In another embodiment, the two or more first and second symbols include a set of clothing patches. In another embodiment, the two or more first and second symbols include a set of buttons. In a further embodiment, the two or more first and second symbols make up a matching game for educating children.

Another embodiment further includes the first article of clothing with the first symbol applied and the second article of clothing with the second symbol applied. In one embodiment, the educational topic comprises an educational topic suitable to instruct a child. In various embodiments, the educational topic includes one or more of mathematics, geography, telling time, vocabulary, reading, counting money, and languages. In one embodiment, the first symbol and the second symbol each include one or more of a letter, a number, a symbol, a shape, a diagram, and a picture.

In another embodiment the first symbol includes a query and the second symbol includes a response to the query. In another embodiment, the first symbol is a problem and the second symbol is an answer to the problem. In another embodiment, the second symbol is a representation of the first symbol in different form. In another embodiment, the first symbol is a graphical representation and the second symbol is a text description. In another embodiment, the first symbol includes text in a first language and the second symbol includes a translation of the text into a second language.

In another embodiment the first symbol is a part of a whole and the second symbol completes the whole. In another embodiment, the first symbol is a representation of two or more parts and the second symbol is a representation of a combination of the parts. In a further embodiment, the first symbol includes a first geographical feature and the second symbol includes a second geographical feature encompassing the first geographical feature. In another embodiment, the first symbol includes a letter and the second symbol represents an object beginning with the letter. In another embodiment, the first symbol includes text and the second symbol indicates the source of the text. In one embodiment, the first symbol includes an expression in a first form and the second symbol includes a matching expression in a different form, wherein the expressions may include a mathematical expression and an expression of time. In another embodiment, the first symbol includes a word and the second symbol includes a graphical expression of the word. In another embodiment, the first symbol includes a quotation and the second symbol includes a citation of the quotation. In a further embodiment, the first symbol includes a word or phrase in a first language and the second symbol includes the word or phrase in a second language. In one embodiment, the first symbol includes a letter in the alphabet in an upper case or lower case form and the second symbol includes a graphical image of an object that begins with the letter. In another embodiment, the first symbol includes a first part of a word and the second symbol includes a second part of the word such that the first part of the word and the second part of the word combined form the word.

In a further embodiment of the invention each symbol is disposed near the toe of its respective sock, with the top of each symbol oriented toward the toe of its respective sock and the bottom of each symbol oriented toward the heel of its respective sock. In another embodiment, one of the first symbol and the second symbol include a connective symbol, the connective symbol indicating the relationship between the first symbol and the second symbol.

In a further aspect of the invention, a sock-matching method for educating children is a matching game. The matching game includes providing several unmatched socks, the several unmatched socks include two or more pairs of socks. Each pair of socks includes a sock with a first symbol applied to the sock and a sock with a second symbol applied to the sock. The first symbol and the second symbol make up a symbol pair where the first symbol is non-identical to the second symbol and the first symbol corresponds to and matches the second symbol based on a relationship of an educational topic. Each symbol pair differs from other symbol pairs of the two or more pairs of socks.

The method further includes selecting a first sock from among the several unmatched socks. The method further includes examining the first symbol of the first sock. The method further includes locating a second sock by examining the several unmatched socks until the second symbol is found, where the first and second symbols make up a symbol pair and the second sock combined with the first sock make up a pair of socks. The method further includes matching the first sock with the second sock, where the first sock is a match for the second sock.

In a further embodiment, the educational topic comprises an educational topic suitable to instruct a child. In one embodiment, two or more of the symbol pairs each have different educational topics. In another embodiment, the sock matching method further includes applying a first symbol to a first sock of a pair of socks and a second symbol to a second sock of the pair of socks, where the first symbol and the second symbol make up a symbol pair. In another embodiment, the sock-matching method further includes applying a first symbol and a second symbol of a symbol pair to each pair of socks of the two or more pairs of socks.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Discussion of the features and advantages, and similar language, throughout this specification may, but do not necessarily, refer to the same embodiment.

The described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention will be rendered by reference to specific embodiments illustrated in the appended drawings, which depict only typical embodiments of the invention and are not to be considered limiting of its scope, in which.

DETAILED DESCRIPTION OF THE INVENTION

Figure 1:
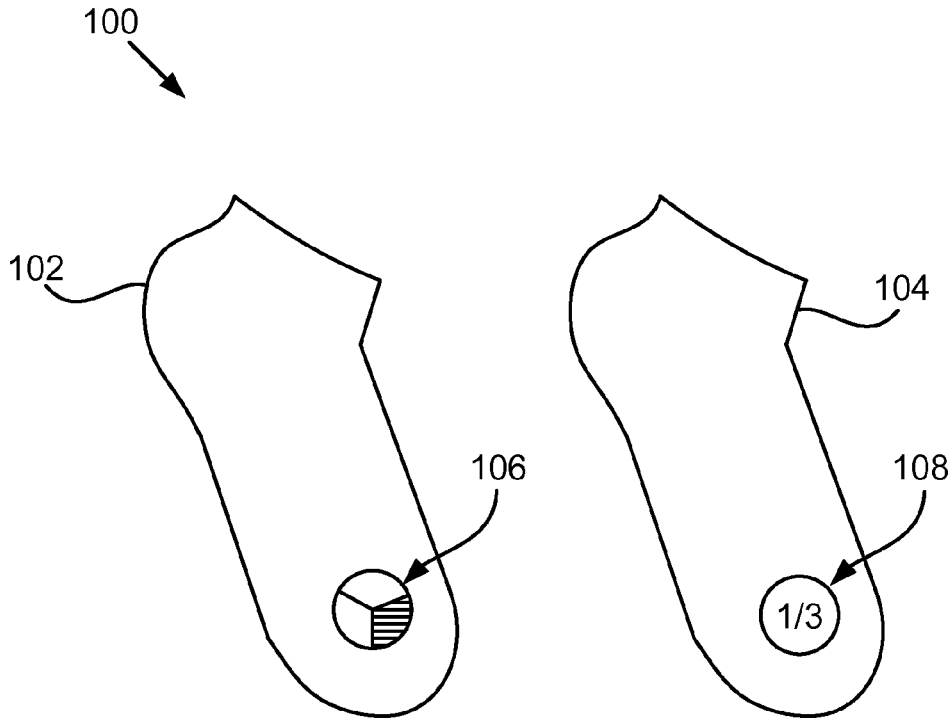
FIG. 1 is a schematic view of an embodiment of a pair of socks on which are disposed corresponding and matching symbols in accordance with the present invention.

Reference throughout this specification to "one embodiment," "an embodiment," or similar language means that a particular feature, structure, or characteristic described in connection with the embodiment is included in at least one embodiment of the present invention. Appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The present invention provides an educational game for children when matching sets of clothing. According to one embodiment, corresponding and matching symbols may be applied to different items in a set of clothing. The symbols may have a relationship that is educational to a child. A child understanding the relationship can then match the clothing accordingly. The educational relationship may embody various concepts. For example, the relationship may include a mathematical relationship which must be understood in order to match the symbols. As an example of symbols having a mathematical relationship, one symbol on one item in the set of clothing may have the characters "2+2=" while a symbol on another item of clothing in the same set has the character "4."

Additionally, the type of clothing sets which may be used may also vary and/or include all types of clothing sets. These clothing sets could include a pair of socks, a pair of stockings, a pair of gloves, or any other set of clothing that are meant to be worn together. Other sets of clothing that are meant to be worn together may include one or more shirts, pants, or hats. For example, a clothing set may include one shirt and one pair of pants that are meant to be worn together. In another example, a clothing set may include a pair of gloves.

As mentioned above, one embodiment of the present invention includes symbols disposed on socks. In one exemplary embodiment several pairs of socks have matching symbols on each sock in a pair, the symbol on each sock of the pair matching a symbol of the other sock of the pair. After socks have been laundered, socks are usually matched into pairs. Thus, after the several pairs of socks have been laundered a child can take part in an educational game of matching socks. A child may compare symbols on socks to determine which sock matches a given sock, teaching and/or reinforcing principles of an educational topic. Thus, helping with laundry becomes a fun and intellectually challenging game for a child.

To emphasize the benefits of the present invention and due to numerous possible variations, the examples provided in the present specification and figures are directed towards symbols on socks or stockings. It will be understood by one skilled in the art in light of the present disclosure that the principles disclosed herein apply to any set of clothing and a set of clothing is not limited to socks.

Referring first to FIG. 1, a pair of stockings or socks 100 comprises a first sock 102 and a second sock 104. A first symbol 106, being a graphical representation of the fraction ⅓, is disposed on the toe of the first sock 102. A second symbol 108, being a numeric representation of the fraction ⅓, is disposed on the second sock 104. The symbols 106 and 108 are not the same, but are associated with one another (in this case, comprising two different ways of representing the same mathematical concept) such that a user looking to pair the socks will, by observing the symbols 106 and 108, and understanding the relationship therebetween, recognize that the socks 102 and 104 are designed to be paired. Additionally, in handling, donning, and wearing the sock pair 100, depending on the placement and orientation of the symbols, the user will observe the symbols and their relationship with each other, reinforcing the concept in his mind.

Figure 2:
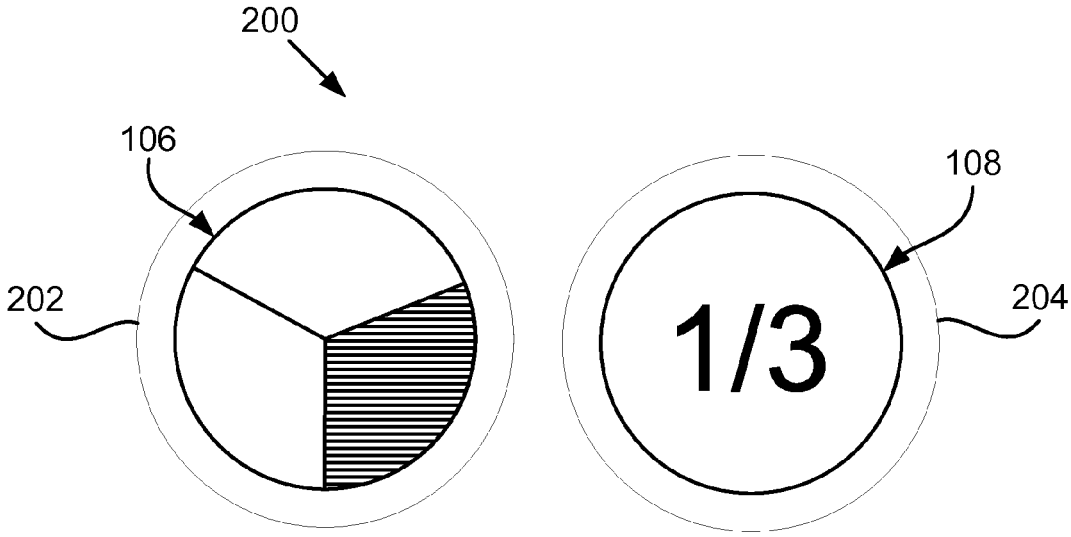
FIG. 2 is a schematic view of one embodiment of a pair of decals having symbols for application to clothing, in accordance with the present invention.

FIG. 2 shows a pair of decals 200 according to one embodiment. The pair of decals 200 are shown having symbols 106, 108 before they are applied to the socks 102, 104. The pair of decals 200 includes a first decal 202 having the first symbol 106 thereon and a second decal 204 having the second symbol 108 thereon. The symbols 106, 108 on the pair of decals 200 are configured to be applied to articles of clothing.

The term "decal", according to the present specification includes a variety of apparatuses which can be used to apply or transfer the symbols 106, 108 to articles of clothing and includes heat transfers, patches, buttons, and the like. Depending on the decal, the symbols 106, 108 are applied to articles of clothing in a variety of ways. For example, if the first and second decals 202, 204 are heat transfers, the symbols 106, 108 may be applied to articles of clothing by using heat. One exemplary type of heat transfer, given by way of illustration and not limitation, is an iron on transfer.

In the case that the decals 202, 204 are iron on transfers, then the symbols 106, 108 may be applied by use of an iron, such as a household iron. According to one embodiment, this is done by heating the desired area for application of an article of clothing and the iron on transfer. For example, an iron may be used to heat the desired area of the clothing, placing the iron on transfer onto the desired area, and then heating the iron on transfer that has been placed on the clothing. The heat helps the image on the iron on transfer, such as one of symbols 106, 108, transfer from the iron on transfer to the article of clothing.

The decals 202, 204 may also be clothing patches or buttons. In this case, the symbols 106, 108 may be applied to an article of clothing by attaching a patch or button to the desired article of clothing. In one embodiment, this is done by sewing the patch or button to the article of clothing. According to another embodiment, the patch or button has an adhesive which allows the article or button to be attached to an article of clothing via the adhesive. The shapes of the decals 202, 204 of the pair of decals 200 are shown having a circular shape. The shape of the decals 202, 204 is only exemplary and may take a variety of shapes and forms.

Figure 3:
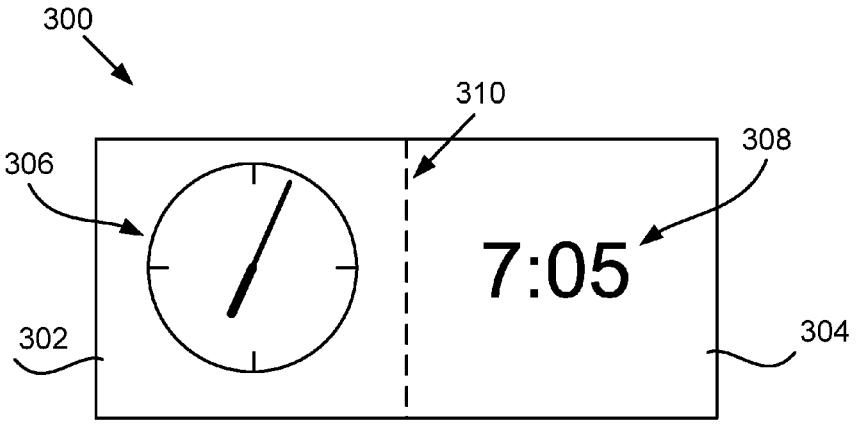
FIG. 3 is another schematic view of a pair of decals having symbols for application to clothing, in accordance with the present invention.

Referring now to FIG. 3, a pair of decals 300 is shown according to another embodiment. The pair of decals 300 is an iron on transfer and includes a first decal 302 having a first symbol 306 and a second decal 304 having a second symbol 308 which are on the same sheet of paper or plastic. The first symbol 306 is an analog representation of the time 7:05 as displayed on a standard analog clock. The second symbol 308 is a numeric representation of the time 7:05. Thus, the symbols 306, 308 correspond and match each other according to the relationship of representing the same time. Since the decals 302, 304 will be applied to separate articles of clothing, they may be separated by cutting along the dotted line 310 with scissors before application. Depending on the type of decal, the decals 302, 304 may also be cut to more closely follow the outline of the symbols 306, 308.

The pair of decals 300 of FIG. 3 allow the matching symbols 306, 308 to be attached to each other until they are ready to be applied to respective articles of clothing. This helps minimize the chances of losing one of the symbols 306, 308 or, in the case where an individual has a large number of decals, this helps to keep them organized. For these reasons, this may be desirable form in which to sell the decals 302, 304.

Figure 4:
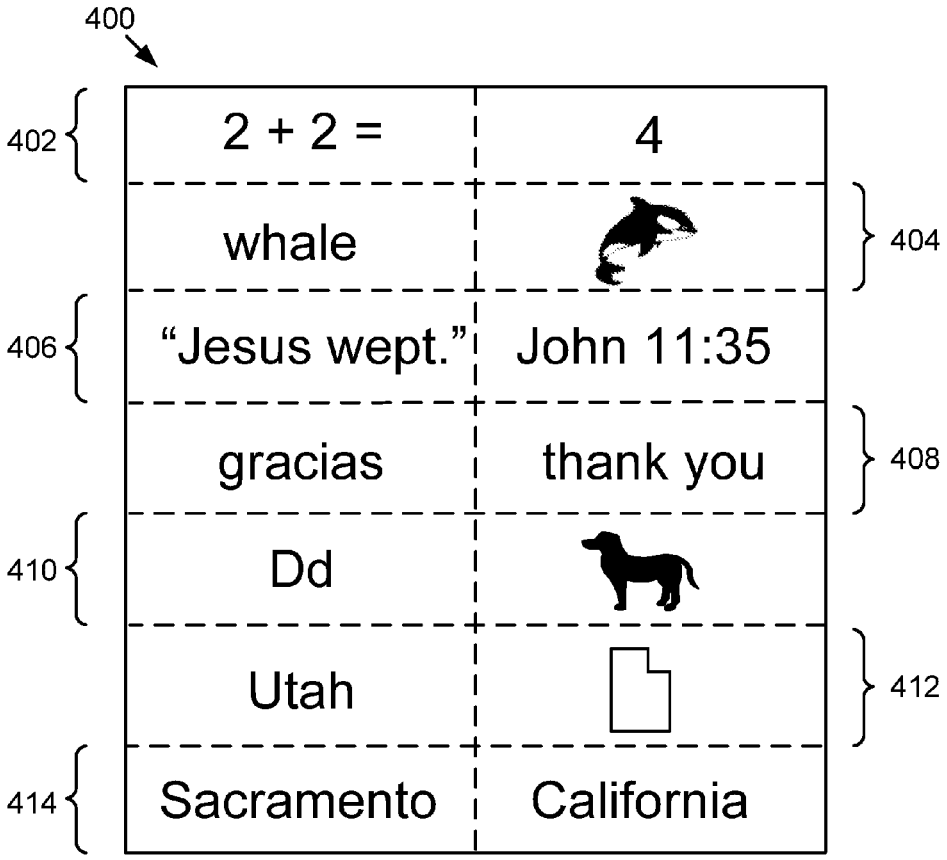
FIG. 4 is a schematic view of one embodiment of several decals on a single sheet, in accordance with the present invention.

FIG. 4 shows a sheet of iron on transfers 400 having six pairs of decals 402-414. The sheet of iron on transfers 400 of FIG. 4 is similar to the sheet of the pair of decals 300 of FIG. 3 except that the sheet of iron on transfers 400 includes six pairs 402-414 rather than just two. The decals of the six pairs of decals 402-414, similar to previous pairs of decals include symbols which correspond to and match each other.

The decals and methods of application as discussed above are only exemplary. As will be understood by one skilled in the art in light of the present disclosure, the symbols 106, 108 may be applied to articles of clothing in a variety of ways including ways not mentioned herein.

Figure 5:
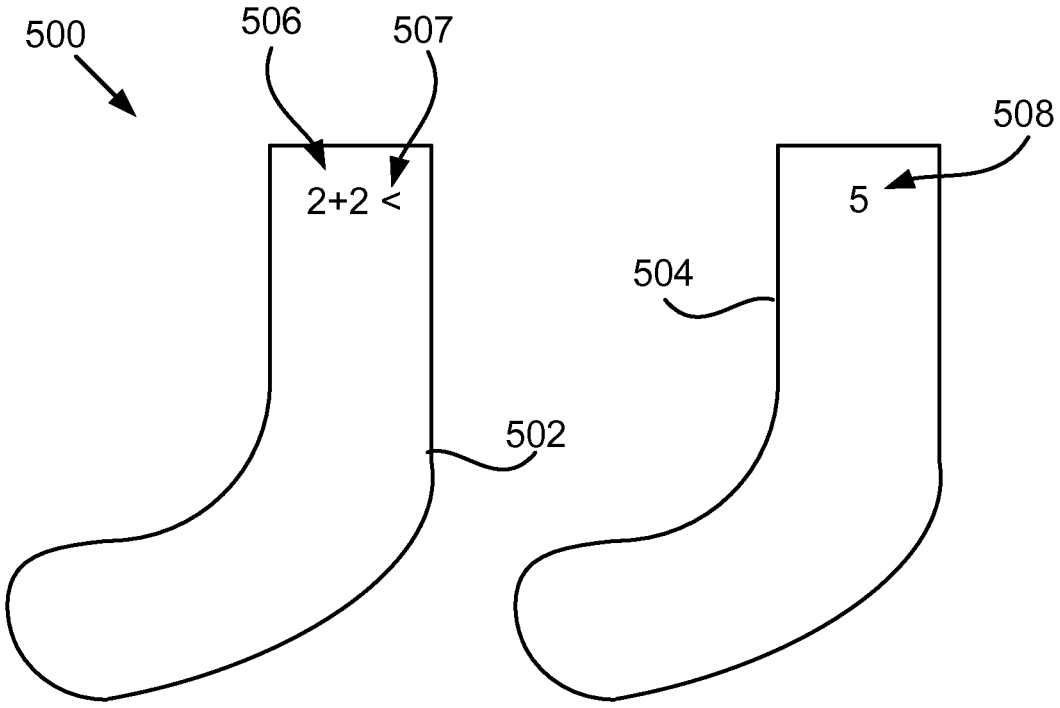
FIG. 5 is a another embodiment of a pair of socks on which are disposed associated symbols according to the present invention.

Referring now to FIG. 5, a pair of socks 500 comprises a first sock 502 and a second sock 504. A first symbol or set of first symbols 506, forming the mathematical problem 2+2, is disposed on or near the top of the first sock 502 on the tube. A connective symbol 507 which is the connective symbol <, meaning "less than," is disposed to the right of the first symbol 506 on the top of the first sock 502. A second symbol 508, which is the number 5, is disposed on or near the top of the second sock 504. As shown, the symbols 506 and 508 are disposed on a location of the socks 502 and 504 different from that shown in FIG. 1, in this case, near the top of the sock on the tube. Depending on the preference of the user, the symbols may be disposed in any location on the sock—toe, heel, leg, instep, sole, etc.—and associated symbols need not be disposed at the same respective locations, i.e., in the case of sock pair 500, the first symbol 506 might be disposed on the heel of the first sock 502 while the second symbol 508 might be disposed on the sole of the second sock 504. Different respective locations for associated symbols provide variety, while the same respective locations provide uniformity and predictability.

Most socks that make up a pair are designed to be substantially identical, i.e., displaying the same basic pattern, color, size, etc. Nevertheless, some of these substantially identical socks are designed such that one should be worn on the user's right foot while the other should be worn on the left. Examples include child's socks with bows, ribbons, or other decorations disposed on one side of the sock, the decorations being configured for display on the outside surface of the leg. Other examples include socks cut to fit around individual toes of the foot.

If the socks 502 and 504 of the pair of socks 500 are each designed for wear on a particular foot, the symbols 506 and 508 may be located on the socks such that they are symmetrical around a center line. For example, if the first sock 502 is designed to be worn on the right foot and the second sock 504 is designed to be worn on the left foot, the first symbol 506 may be located on the first sock 502 such that it is located on the right side of the sock, i.e., on the outside of the user's foot when the socks are placed on the correct feet. Similarly, the second symbol 508 may be disposed on the left side of the second sock 504.

The relationship between the symbols 506 and 508 is one of mathematical inequality; the first symbol 506 (2+2) is less than the second symbol 508 (5), as indicated by the connective symbol 507 (<). The connective symbol 507 or other mathematical connective symbols including =, –, /, >, *, ≡, ≠, √, ≈, and others may be used in conjunction with a set of socks according to the invention that have disposed thereon symbols that have a mathematical relationship. It will be understood by one skilled in the art that these connective symbols are only exemplary and that numerous other connective symbols may be used.

Figure 6:
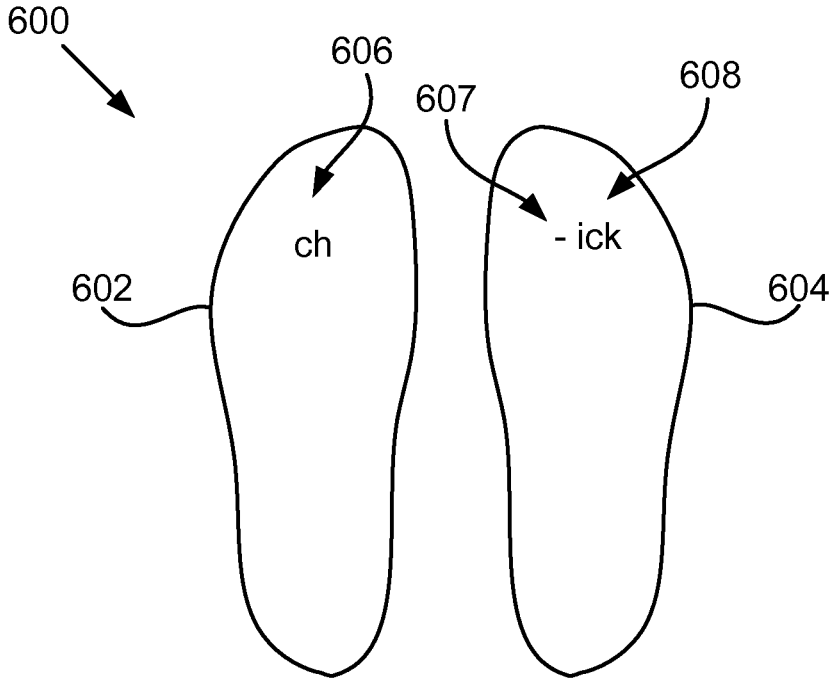
FIG. 6 is a top plan view of another embodiment illustrating a pair of socks on which are disposed associated symbols according to the present invention.

Referring now to FIG. 6, a pair of socks 600 comprises a first sock 602 and a second sock 604. The socks 600 are shown in a plan view showing the top of feet covered by socks 602, 604, with the heel oriented toward the bottom of the page and the toe oriented toward the top of the page. The symbols 606 and 608 are oriented with the top of the symbol toward the toe of the sock and the bottom of the symbol toward the heel or top of the sock such that the user can see them in their proper orientation, i.e., right side up, while the sock pair 600 is being worn.

A first symbol (meaning a single symbol or set of symbols) 606, comprising the letters "ch," is disposed on or near the toe of the first sock 602. A connective symbol 607 comprising the connective symbol "–" is disposed on the toe of the second sock 604 to the left of the second symbol 608, which second symbol 608 comprises the letters "ick." The first sock 602 is designed for wear on the user's left foot, with the second sock 604 designed for wear on the user's right foot, such that the symbols 606, 607, and 608 show "ch-ick," or, without the connective symbol 607, the word "chick." Such symbols are useful for teaching or reinforcing reading. Note that in the case of the sock pair 600, the connective symbol 607 is disposed on the second sock 604 (the right sock), as opposed to the left sock (the first sock 602) in the sock pair 600.

Other connective symbols may be used for symbols that are associated with each other, but not necessarily mathematically. These symbols may comprise, for example, –, →, ?, or letters and words such as "is the same as," "is the capitol of," "is from," "uses," "is within," or other connective language or other symbology, according to the particular embodiment. The connective symbol may be disposed on either sock, or spread between both socks (such as splitting the connective symbol "is within" between the left and right socks such that "is" is on the left sock and "within" is on the right sock). If used, the connective symbol serves as further guidance for the user to associate the symbols, as well as to indicate which sock is configured to be placed on the left foot, and which on the right.

If a connective symbol is not used, generally it will make no difference which sock is placed on the left foot and which on the right, as symbols placed on them according to the invention will generally associate with each other whatever order they are placed in.Table 1, below, illustrates examples of related symbols that may be placed on sock pairs according to the present invention. It also illustrates examples of connective symbols that may be used with the associated symbols, if desired. As will be apparent to those skilled in the art in light of this disclosure, the connective symbols are optional. If they are used, in certain embodiments they may be placed either on the left sock (at the right of the first symbol) or on the right sock (at the left of the second symbol). As will also be apparent, the first and second symbols may be reversed in order if the connective symbols are not used. If the connective symbols are used, the order of the first and second symbols often may still be reversed, though the nature of some connective symbols makes the order of their associated first and second symbols unchangeable.

The symbols in Table 1 are only examples of almost innumerable symbols and combinations of symbols possible according to the present invention, as long as they are associated in some way.

TABLE 1

| First Symbol | Connective Symbol | Second Symbol |
|---|---|---|
| blue triangle | ≡ | Δ |
| 25¢ | is the same as | |
| Three | = | III |
| thank you | in Spanish is | gracias |
| | is a | mountain |
| Nose | looks like | |
| Salt Lake City | is the capitol of | |
| best | in cursive is | best |
| | starts with | Z |
| "Jesus wept." | is from | John 11:35 |
| Mt. Kilimanjaro | is in | Kenya |
| yellow and blue | → | green |
| Utah | uses | Mountain Standard Time |

The exemplary symbols shown in FIGS. 1-6 as well as Table 1 illustrate some possible relationships between relate symbols. The related symbols 106, 108 of FIGS. 1 and 2 are related in that they both represent the concept of the mathematical fraction ⅓. This may help a child to understand and conceptualize the meaning of the fraction. FIG. 3 depicts symbols 306, 308 which are related in that they both represent the same time. This relationship may help children to learn read clocks and tell time. Pair 402 of FIG. 4 depicts symbols representing the mathematical equation 2+2=4 with the symbols related in that they are equal to each other. This and similar equations may help children learn to learn how to add, subtract, multiply, divide, and/or perform other mathematical operations. Pair 404 includes symbols which are related in that they both represent a whale with one symbol in textual form and one in picture form. Such a relationship between symbols may teach or reinforce reading skills for children. The symbols of pair 406 are related in that one symbol is a quotation and the other symbol is a citation to the source of the quotation. This and similar symbol pairs may help a child to memorize information and the source of that information. Furthermore, they may also be used to reinforce positive concepts for children.

The symbols of pair 408 of FIG. 4 are related in that they are words that mean the same thing in different languages. This and similar pairs may be used to help children to learn a new language and/or expand their vocabulary in a second language. The symbols of pair 410 are related in that one symbol represents the letter which the word "dog" begins and the other symbol is a picture of a dog. This and similar relationships may help children to learn letters and how to read. Pair 412 represents a geographic relationship which may help a child to memorize geographic locations or other geographic facts. Pair 414 represents another geographic relationship where the first symbol includes a first geographical feature and the second symbol includes a second geographical feature encompassing the first geographical feature. For example, a first symbol may be a state capital and the second symbol may be the state corresponding to the state capital. For instance, Sacramento and California 414 may be a match.

One further type of relationship which may be desirable between two symbols according to the invention is an explicit query and answer, such as the first symbol being the question "43$^{rd}$ U.S. president?" and the second symbol being the answer "George W. Bush." Some of the discussed pairs of symbols involve an implicit query and answer, such as the question noted above without the question mark, a mathematical problem, or other implicit query, such as "blue and yellow," with the answer being "green." The order of the query and answer as viewed by the user may be reversed, with each symbol comprising an answer to the implicit query of the other.

Exemplary topics in which relationships may be taught include The exemplary symbols and discussed relationships are by no means exhaustive. It will be understood by one skilled in the art in light of the present disclosure that numerable The schematic flow chart and method schematic diagrams that follow are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 7:
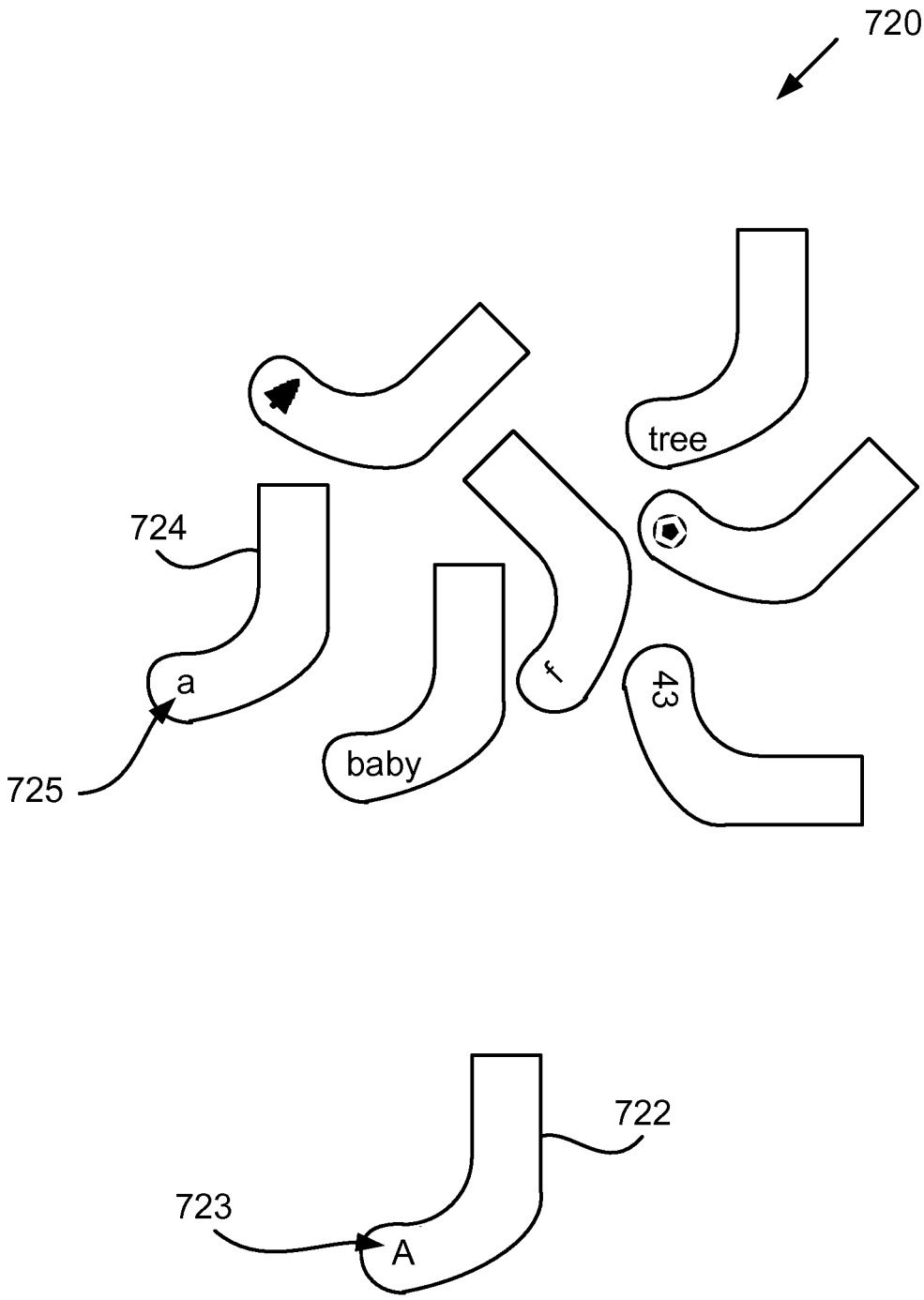
FIG. 7 is a schematic view of a plurality of socks, illustrating an embodiment of a method of choosing matching socks according to the present invention.
Figure 8:
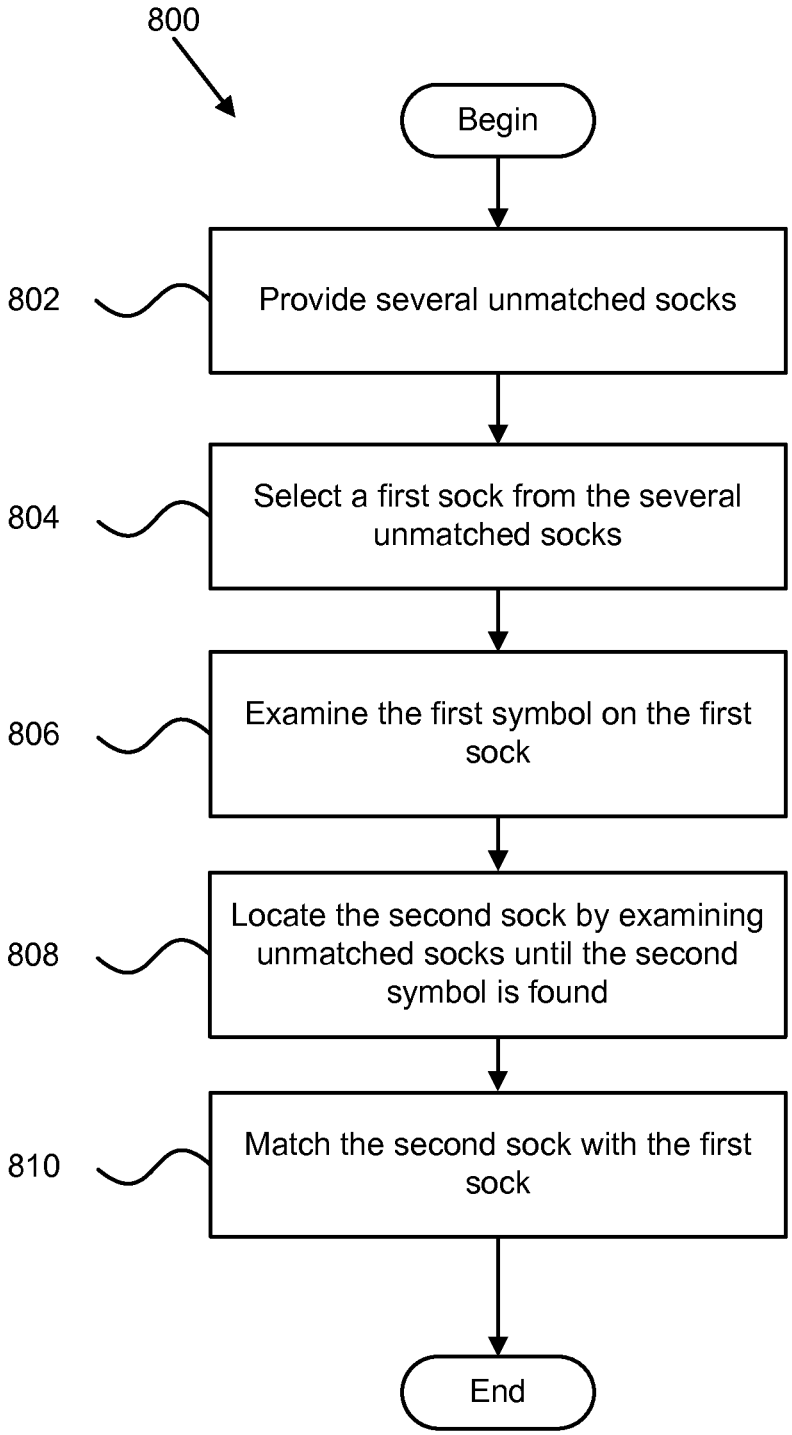
FIG. 8 is a schematic flow chart diagram illustrating a method of choosing matching socks, in accordance with the present invention.

Referring now to FIGS. 7 and 8, a method 800 of choosing matching socks from several socks 702 is illustrated. The method 800 begins and several unmatched socks 720 are provided 802. The several unmatched socks 720 may be, for instance, a basket load of socks after the laundry is done. Each sock of the several unmatched socks 720 may or may not have a symbol disposed thereon, but at least two socks must each have a symbol disposed thereon according to the present invention.

A first sock 722 having disposed thereon a first symbol 723 is selected 804 from the several unmatched socks 720 and the first symbol 723 is examined 806. In the illustrated embodiment, the first symbol 723 is an upper-case "A." A second sock 724 having disposed thereon a second symbol 725 which is associated with the first symbol 723 is then located 808 from the several unmatched socks 720. Locating 808 the second sock 724 from the several unmatched socks 720 is done by examining unmatched socks 720 until the second symbol 725 which corresponds to and matches the first symbol 723 is found. In the illustrated embodiment, the second symbol 725 is a lower-case "a," though any symbol associated with the first symbol 723 may be used. When the first sock 722 and the second sock 724 are located and the relationship between the symbols 723, 725 is recognized and understood the socks 722, 724 are matched 810 and the method 800 ends. The method 800 may be repeated any number of times until all the matching socks have been located and paired.

It can be seen that in the present invention provides for education of youngsters and others who may be learning to read, learning arithmetic, other mathematical functions, geography, different languages, textual citations, telling time, shapes, or any of a multitude of other principles. Furthermore, those doing laundry may find children more willing and happy to health because matching socks has become a game.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sock-matching method for educating children using a matching game, the method comprising:

obtaining multiple pairs of socks, the multiple pairs of socks consisting of:

two or more pairs of socks, each sock is a garment for wearing on a foot, each pair of socks comprising a first sock and a second sock, the socks of the multiple pairs of socks arranged in an unmatched state;

a plurality of first symbols, each first symbol permanently applied to a first sock of the multiple pairs of socks; and a plurality of second symbols, each second symbol permanently applied to a second sock of the multiple pairs of socks, wherein each first symbol corresponds to a second symbol to form a symbol pair, wherein within each symbol pair the first symbol is non-identical to the second symbol and the first symbol of a symbol pair corresponds to and matches with the second symbol in the symbol pair and wherein each symbol pair differs from other symbol pairs of the multiple pairs of socks, and wherein the first symbol in the symbol pair and the second symbol of the symbol pair each consist of a printed image;

selecting a first sock of a pair of socks from among the unmatched socks;

examining the first symbol of the first sock;

locating a second sock of the pair of socks by examining the several unmatched socks until the second symbol is found, the first and second symbols comprising a symbol pair, the second sock combined with the first sock comprising a pair of socks, wherein locating the second sock comprises one of identifying that the first symbol on the first sock consists of a time expression in a first form and the second symbol on the second sock is a same time expression in a different form;

identifying that the first symbol on the first sock consists of a word and the second symbol on the second sock consists of a graphical expression of the word;

identifying that the first symbol on the first sock consists of a quotation and the second symbol on the second sock consists of a citation of the quotation;

identifying that the first symbol on the first sock consists of a word or phrase in a first language and the second symbol on the second sock consists of the word or phrase in a second language;

identifying that the first symbol on the first sock consists of a letter in the alphabet in one or more of an upper case form and a lower case form and the second symbol on the second sock consists of a graphical image of an object that begins with the letter; and identifying that the first symbol on the first sock consists of a first part of a word and the second symbol on the second sock consists of a second part of the word, the first part of the word and the second part of the word combined form the word; and matching the first sock with the second sock, wherein the first sock is a match for the second sock.

2. The sock-matching method of claim 1, wherein two or more of the symbol pairs of the multiple pairs of socks each have different educational topics.

3. The sock-matching method of claim 1, wherein the first and second symbols of each symbol pair comprise a set of iron-on transfers applied to the multiple pairs of socks.

4. The sock-matching method of claim 1, wherein the first and second symbols of each symbol pair comprise a set of clothing patches applied to the multiple pairs of socks.

5. The sock-matching method of claim 1, wherein the first and second symbols of each symbol pair comprise a set of buttons applied to the multiple pairs of socks.

6. The sock-matching method claim 1, wherein each symbol is disposed near the toe of its respective sock.

7. The sock-matching method of claim 1, wherein the top of each symbol is oriented toward the toe of its respective sock and the bottom of each symbol is oriented toward the heel of its respective sock.

* * * * *